US005286393A

United States Patent [19]

Oldiges et al.

[11] Patent Number: 5,286,393

[45] Date of Patent: Feb. 15, 1994

[54] COATING AND BONDING COMPOSITION

[75] Inventors: Donald A. Oldiges, Cypress; Anthony W. Joseph, Houston, both of Tex.

[73] Assignee: Jet-Lube, Inc., Houston, Tex.

[21] Appl. No.: 870,132

[22] Filed: Apr. 15, 1992

[51] Int. Cl.[5] ..... C10M 113/08; C10M 111/04

[52] U.S. Cl. ..... 252/26; 106/287.18

[58] Field of Search ..... 106/205, 253, 266, 287.17, 106/287.18, 403, 404; 252/26

[56] References Cited

U.S. PATENT DOCUMENTS

| | | | |
|---|---|---|---|
| 1,586,087 | 5/1926 | Howe et al. . | |
| 2,419,144 | 4/1947 | Kelly . | |
| 2,537,629 | 1/1951 | Brown . | |
| 2,543,741 | 2/1951 | Zweifel . | |
| 2,581,301 | 1/1952 | Saywell | 252/26 |
| 2,700,623 | 1/1955 | Hall | 252/26 |
| 2,754,266 | 7/1956 | Stegemeier et al. . | |
| 3,423,315 | 1/1969 | McCarthy et al. . | |
| 3,514,400 | 5/1970 | Hotten . | |
| 3,652,414 | 3/1972 | Bergeron . | |
| 3,652,415 | 3/1972 | Bergeron . | |
| 3,784,264 | 1/1974 | Jackson, Jr. . | |
| 3,801,506 | 4/1974 | Cross et al. . | |
| 3,843,528 | 10/1974 | Bailey et al. . | |
| 3,935,114 | 1/1976 | Donaho, Jr. . | |
| 4,155,860 | 5/1979 | Soucy . | |
| 4,256,811 | 3/1981 | Black | 428/562 |
| 4,329,238 | 5/1982 | Mitrofanova et al. | 252/12 |
| 4,358,384 | 11/1982 | Newcomb . | |
| 4,379,062 | 4/1983 | Prengaman . | |
| 4,525,287 | 6/1985 | Larstensen | 252/26 |
| 5,093,015 | 3/1992 | Oldiges . | |

FOREIGN PATENT DOCUMENTS 55082-196 12/1978 Japan .

OTHER PUBLICATIONS

API Bulletin 5A2, Sixth Edition, "Bulletin on Thread Compounds for Casing, Tubing, and Line Pipe," issued by American Petroleum Institute (May 31, 1988).

*Primary Examiner*—David Brunsman

*Attorney, Agent, or Firm*—Arnold, White & Durkee

[57] ABSTRACT

A coating and bonding composition is disclosed. The composition includes suspending, bonding and thinning agents, and a metallic flake. The composition may be used with an environmentally friendly lubricating composition to form an environmentally friendly lubricating system for protecting threaded connections from galling or other damage. That system may be used in a method for protecting threaded connections that includes the steps of: coating the threads, prior to make-up, with the coating and bonding composition and then coating them with the environmentally friendly lubricating composition, after the coated threads have dried.

5 Claims, No Drawings

COATING AND BONDING COMPOSITION

BACKGROUND OF THE INVENTION

The present invention relates to coating and bonding compositions for threaded connections, such as, for example, for oilfield tool joints, drill collars, casing, tubing, line pipe, flow lines and subsurface production tools. Such a composition may be used with an environmentally friendly lubricating composition providing an environmentally friendly lubricating system, for example, for oilfield uses.

Oilfield thread forms require products with high film strength and a certain range in coefficient of friction. Because thread faces are often subjected to bearing stresses in excess of 50,000 psi, excessive rotation could result in bearing stresses capable of rupturing the protective film and leading to subsequent galling and damage to the pipe. Anti-seize compounds are used to protect against the damage that high bearing stresses may otherwise cause by providing a dissimilar metal or other material between like substrates. Such a compound inhibits the "welding" that may otherwise occur under the pressures and heat incurred during proper make-up.

Conventionally used anti-seize thread compounds include greases which contain substantial amounts of heavy metals or their oxides, carbonates or phosphates. Such metals include: copper, zinc, lead, nickel, molybdenum and aluminum. Recent environmental regulations have begun to discourage, and in some cases prohibit, the use of anti-seize compounds that contain such materials. Organic fluid additives containing antimony, zinc, molybdenum, barium and phosphorus have become the subject of environmental scrutiny as well.

Although it is becoming increasingly unacceptable to include such materials in anti-seize compounds, compounds that do not include them generally do not, by themselves, provide the film strength needed to protect threaded connections from galling or other damage, when subjected to high bearing stresses.

One of the reasons why such compounds are disfavored results from the way they are used. Oilfield threaded connections are usually coated with an excess amount of the thread compound to ensure complete connection coverage. The excess compound is sloughed off so that it ends up downhole. It is then included with the other materials pumped out of the wellhole and into a containment area. From there, material contaminated with heavy metals must be removed to a hazardous waste disposal site.

There is a need for an environmentally friendly lubricating system that still provides adequate protection against galling and other damage to threaded connections subject to high bearing stresses, such as those on oilfield tool joints and drill collars.

There is a need for such a system that provides adequate film strength properties to protect such threaded connections from galling or failure.

There is a need for such a system that reduces the additional downhole make-up of threaded connections used in oilfield drilling operations, such as tool joints and drill collars, which may cause galling or other connection damage.

There is a need for a system for protecting threaded connections, enabling acceptable thread make-up, and restricting downhole make-up that also minimizes the amount of heavy metals leached into the drilling effluent.

There is a need for a system for protecting threaded connections used in drilling operations that should not require hazardous waste classification.

The coating and bonding composition of the present invention enables such a system.

SUMMARY OF THE INVENTION

The present invention provides a coating and bonding composition comprising:

a suspending agent;
a bonding agent;
a thinning agent; and
a metallic flake.

The coating and bonding composition preferably is a solvent thinned resin based coating and bonding composition that may be used to protect oilfield threaded connections. The coating and bonding composition of the present invention may be used in combination with an environmentally friendly lubricating composition forming an environmentally friendly lubricating system.

The present invention further provides a method for protecting threaded connections comprising:

coating the threads, prior to their make-up, with a solvent thinned resin based coating and bonding composition comprising a suspending agent, a bonding agent, a thinning agent, and a metallic flake;

drying the coated threads for a time sufficient to bond the coating and bonding composition to the threads; and coating the threads, prior to their make-up, with an excess amount of an environmentally friendly lubricating composition.

With such a method, it is believed that the metallic flake "bonds" to the surface of the threads upon which the coating and bonding composition is applied. Such "bonding" provides anti-seize protection while minimizing the amount of metal released into the environment. In such a method, thread wear alone discharges metal into the environment. Metal contamination is thus substantially reduced, when compared to present methods that coat the threads with excess amounts of metal contained in oil based lubricants, a significant amount of which may be leached into drilling mud and other fluids used in drilling operations.

DETAILED DESCRIPTION OF SPECIFIC EMBODIMENTS

This invention is a coating and bonding composition that may be used as part of a system for sealing and for anti-seize protection for tool joints, drill collars, casing, tubing, line pipe, flow lines, subsurface production tools, and the like. The composition of the present invention is particularly preferred for use in oil drilling operations.

In the coating and bonding composition of the present invention, suspending, bonding and thinning agents are combined with a metallic flake, producing a composition that may be coated onto the threads of connecting members prior to make-up.

The suspending agent includes any material that may be used to uniformly suspend the composition's other components, in particular, the metallic flake. Preferred suspending agents include those conventionally used in paints and coatings, including, for example, thixotropic base materials, such as, but not limited to, those including cellulose, clay or silica.

The bonding agent includes any material that may bond the metallic flake to the threads. Preferably, the bonding agent also encapsulates the metallic flake, inhibiting that component's toxicity. Preferred bonding agents include organic resins, such as resins derived from acrylics, silicones, urethanes, alkyds, hydrocarbons, epoxies, and lacquers.

The thinning agent includes any material that ensures that the bonding agent will not harden prior to coating the composition onto the threads. Preferred thinning agents include organic solvents, such as aliphatic, aromatic, ketone, aldehyde, ester, acetate, ether, terpene and chlorinated and cyclopentasiloxane solvents.

The metallic flake includes those conventionally used for anti-seize compounds including, for example, copper, aluminum, tin, brass, bronze, nickel and stainless steel.

The suspending, bonding and thinning agents, and the metallic flake, may include a single component or a multiple number of components. For example, the thinning agent may include a combination of solvents having slow and fast evaporating rates. In such an embodiment of the present invention, the fast evaporating solvent inhibits the running and sagging of the film, while the slower evaporating solvent inhibits pin hole formation and promotes surface bonding.

The coating and bonding composition of the present invention may be made using conventional mixing techniques. The components of the composition should be sufficiently blended until they obtain a homogeneous mixture. For smaller quantities, blending may take place in a hobart or drum cowles mixer. For larger quantities, the composition may be made by combining the components in a large kettle mixer and milling them together to produce a homogeneous mixture.

The coating and bonding composition of the present invention may be a solvent thinned resin based composition. Such a composition preferably includes about 0.1-15% by weight of the suspending agent, about 1.0-15% by weight of the bonding agent, about 55-95% by weight of the thinning agent, and about 2.0-25% by weight of the metallic flake. More preferably, the solvent thinned resin based composition includes about 0.1-5.0% by weight of the suspending agent, which may include cellulose, clay or silica; about 2.0-10.0% by weight of the bonding agent, which may include an acrylic, a silicone, a urethane, an alkyd, a hydrocarbon, an epoxy, or a lacquer; about 65-90% by weight of the thinning agent, which may include an aliphatic, aromatic, ketone, aldehyde, ester, acetate, ether, terpene, chlorinated or cyclopentasiloxane solvent; and about 5.0-17% by weight of the metallic flake, which may include copper, aluminum, tin, brass, bronze, nickel or stainless steel.

Most preferably, such a composition includes about 1.0-3.0% by weight of an ethyl cellulose suspending agent, about 3.0-6.0% by weight of a thermosetting silicone resin bonding agent, about 79-89% by weight of a mixed solvent thinning agent, and about 7.0-12% by weight of micro-sized copper flakes. Such a composition should be applied to the threads of the connecting members and allowed to air-dry, preferably for at least one hour. Such a bonded copper film has been observed to provide favorable galling resistance. In addition, such a silicone resin coats the copper flake, rendering it substantially inactive, minimizing its toxicity.

The coating and bonding composition of the present invention may be an oilfield threaded connection coating and bonding composition that includes:

- about 1.0-5.0% by weight of a suspending agent selected from the group consisting of cellulose, clay and silica;
- about 2.0-8.0% by weight of a bonding agent selected from the group consisting of an acrylic, a silicone, a urethane, an alkyd, a hydrocarbon, an epoxy, and a lacquer;
- about 70-90% by weight of a thinning agent selected from the group consisting of aliphatic, aromatic, ketone, aldehyde, ester, acetate, ether, terpene, chlorinated and cyclopentasiloxane solvents; and
- about 5.0-20% by weight of a metallic flake selected from the group consisting of copper, aluminum, tin, brass, bronze, nickel and stainless steel.

Such an oilfield threaded connection coating and bonding composition preferably includes about 1.0-3.0% by weight of an ethyl cellulose suspending agent, about 3.0-6.0% by weight of a thermosetting silicone resin bonding agent, about 79-89% by weight of an aromatic thinning agent, and about 7.0-12% by weight of a copper flake.

The following examples are illustrative of the coating and bonding composition of the present invention. It will be appreciated, of course, that the proportions of components are variable. Selection of different suspending, bonding and thinning agents, and metallic flakes, and selection of different weight percentages of such components, can be readily made. Moreover, additional materials that may be added to the composition are a matter of design choice. The examples are thus not in any way to be construed as limitations upon the scope of the present invention.

EXAMPLE 1

| EXAMPLE 1 | |
|---|---|
| Component | Percentage by weight of total composition |
| suspending agent[1] | 2% |
| bonding agent[2] | 6% |
| thinning agent[3] | 84% |
| metallic flake[4] | 8% |

[1]Ethyl cellulose, sold under the tradename EHEC by Aqualon.
[2]Thermosetting silicone resin, sold under the tradename Silikophen P80/X by Tego Chemie Service USA.
[3]A mixture of one part by weight xylene, such as may be obtained from Hill Petroleum, and two parts by weight 1:1:1 trichloroethane, sold under the tradename Chlorothene by DuPont.
[4]Copper flake, sold by Atlantic Powdererd Metals.

Table I lists certain properties for the coating and bonding composition of Example 1.

TABLE I

| | |
|---|---|
| Color | Copper Colored fluid with characteristic solvent odor |
| Appearance: | A suspension of micro-sized copper flakes |
| Density: | 10.0 pounds per gallon |
| Wt. % Solids: | 14.0 |
| Flash Point: | 80° F. |
| Typical Coverage: | 2,400 sq. in. per 12 ounce aerosol can<br>43,500 sq. in. per 1 gallon - bulk |

TABLE I-continued

| | |
|---|---|
| Pencil Hardness, ASTM: | 1 to 24 hr. ambient = 4B min.<br>3 weeks @ ambient = 2B min.<br>1 hr. @ 200° F. = 3B min.<br>24 hr. @ 200° F. = 1H min. |

EXAMPLE 2

| Component | EXAMPLE 2<br>Percentage by weight of total composition |
|---|---|
| suspending agent[5] | 1.8% |
| bonding agent[6] | 4.4% |
| thinning agent[7] | 82.2% |
| metallic flake[8] | 11.6% |

[5]Ethyl cellulose, sold under the tradename EHEC by Aqualon.
[6]Thermosetting silicone resin, sold under the tradename Silikophen P80/X by Tego Chemie Service USA.
[7]A mixture of one part by weight xylene, such as may be obtained from Hill Petroleum, and two parts by weight 1:1:1 trichloroethane, sold under the tradename Chlorothene by DuPont.
[8]Copper flake, sold by Atlantic Powdered Metals.

Table II lists certain properties for the coating and bonding composition of Example 2.

TABLE II

| | |
|---|---|
| Color | Copper Colored fluid with characteristic solvent odor |
| Appearance: | A suspension of micro-sized copper flakes |
| Density: | 10.42 pounds per gallon |
| Wt. % Solids: | 17.0 |
| Flash Point: | 80° F. |
| Typical Coverage: | 2,400 sq. in. per 12 ounce aerosol can<br>43,500 sq. in. per 1 gallon - bulk |
| Pencil Hardness, ASTM: | 1 to 24 hr. ambient = 4B min.<br>3 weeks @ ambient = 2B min.<br>1 hr. @ 200° F. = 3B min.<br>24 hr. @ 200° F. = 1H min. |

The coating and bonding composition of the present invention may be used in an environmentally friendly lubricating system that includes that composition together with an environmentally friendly lubricating composition, such as a synthetic or petroleum based fluid.

Preferred synthetic based fluid compositions include those having a viscosity range of about 20–400 centistokes, including polyalphaolefins, polybutenes, and polyolesters having a viscosity within that range. Preferred polyalphaolefins include those sold by Mobil Chemical Company as SHF fluids and those sold by Ethyl Corporation under the name ETHYLFLO. Such products include those specified as ETHYLFLO 162, 164, 166, 168 and 174, which are believed to be 6, 18, 32, 45 and 460 centistoke products, respectively. Particularly preferred is a blend of about 56% of the 460 centistoke product and about 44% of the 45 centistoke product. Preferred polybutenes include those sold by Amoco Chemical Company and Exxon Chemical Company under the tradenames INDOPOL and PARAPOL, respectively. Particularly preferred is Amoco's INDOPOL L100. Preferred polyolesters include neopentyl glycols, trimethylolpropanes, pentaerythritols and dipentaerythritols.

Preferred petroleum based fluid compositions include white mineral, paraffinic and MVI naphthenic oils having a viscosity range of about 20–400 centistokes. Preferred white mineral oils include those available from Witco Corporation, Arco Chemical Company, PSI and Penreco. Preferred paraffinic oils include solvent neutral oils available from Exxon Chemical Company, HVI neutral oils available from Shell Chemical Company, and solvent treated neutral oils available from Arco Chemical Company. Preferred MVI naphthenic oils include solvent extracted coasted pale oils available from Exxon Chemical Company, MVI extracted/acid treated oils available from Shell Chemical Company, and naphthenic oils sold under the names HydroCal and Calsol by Calumet.

The environmentally friendly lubricating composition may consist of a single fluid or a combination of several different fluids so long as the composition provides acceptable performance properties and complies with pertinent environmental regulations. Such a composition may include minor amounts of naturally derived non-toxic solid fillers, such as, for example, calcium carbonate, tricalcium phosphate, cerium fluoride, graphite, mica or talc. The composition may further include conventionally used rust, corrosion and/or oxidation inhibitors. If such additives are desired, they may be mixed into the compositions specified above using conventional mixing techniques.

Such an environmentally friendly lubricating system may be used in a method for protecting threaded connections that includes the following steps:

coating the threads, prior to their make-up, with the solvent thinned resin based coating and bonding composition comprising a suspending agent, a bonding agent, a thinning agent, and a metallic flake;

drying the coated threads for a time sufficient to bond the coating and bonding composition to the threads; and coating the threads, prior to their make-up, with an excess amount of the environmentally friendly lubricating composition.

The solvent thinned resin and bonding composition may be applied to the threads by simply brushing it on, or, alternatively, by including it in an aerosol spray system, and then simply spraying it onto the threads. The environmentally friendly lubricating composition may be applied to the threads, after the coating composition has dried, by simply brushing it on the threads.

Such a method preferably includes the step of heating the threads after they have been coated with the solvent thinned resin based coating and bonding composition for a sufficient time to increase the resulting film's durability and resistance to galling. A propane torch may be used to heat the system. Such a heating step should enhance bonding.

An environmentally friendly lubricating composition should be selected that is free of environmentally hazardous substances while still providing friction resistance properties for favorable threaded connection protection, proper engagement of threaded members when subjected to API torque values, and acceptable resistance to downhole make-up, when used with the film formed from the coating and bonding composition of the present invention.

Additional advantages and modifications will readily occur to those skilled in the art. The invention in its broader aspects is therefore not limited to the specific details and the illustrative examples as shown and described.

What is claimed is:

1. A resin based coating and bonding composition comprising:
- about 0.1–15% by weight of a suspending agent selected from the group consisting of cellulose, clay and silica;
- about 1.0–15% by weight of a bonding agent selected from the group consisting of an acrylic, a silicone, a urethane, an alkyd, a hydrocarbon, an epoxy, and a lacquer;
- about 55–95% by weight of a thinning agent selected from the group consisting of aliphatic, aromatic, ketone, aldehyde, ester, ether, terpene, chlorinated hydrocarbon and cyclopentasiloxane solvents; and
- about 2.0–25% by weight of a metallic flake selected from the group consisting of copper, aluminum, tin, brass, bronze, nickel and stainless steel.

2. The resin based coating and bonding composition of claim 1 wherein the composition comprises:
- about 0.1–5.0% by weight of the suspending agent;
- about 2.0–10.0 by weight of the bonding agent;
- about 65–90% by weight of the thinning agent; and
- about 5.0–17% by weight of the metallic flake.

3. The resin based coating and bonding composition of claim 1 wherein the composition comprises:
- about 1.0–3.0% by weight of the suspending agent;
- about 3.0–6.0 by weight of the bonding agent;
- about 79–89% by weight of the thinning agent; and
- about 7.0–12% by weight of the metallic flake.

4. An oilfield threaded connection coating and bonding composition comprising:
- about 1.0–5.0% by weight of a suspending agent selected from the group consisting of ethyl cellulose, clay and silica;
- about 2.0–8.0% by weight of a bonding agent selected from the group consisting of an acrylic, a silicone, a urethane, an alkyd, a hydrocarbon, an epoxy, and a lacquer;
- about 70–90% by weight of a thinning agent selected from the group consisting of aliphatic, aromatic, ketone, aldehyde, ester, ether, terpene, chlorinated hydrocarbon and cyclopentasiloxane solvents; and
- about 5.0–20% by weight of a metallic flake selected from the group consisting of copper, aluminum, tin, brass, bronze, nickel and stainless steel.

5. The oilfield threaded connection coating and bonding composition of claim 4 comprising:
- about 1.0–3.0% by weight of an ethyl cellulose suspending agent;
- about 3.0–6.0% by weight of a thermosetting silicone resin bonding agent;
- about 79–89% by weight of an aromatic solvent thinning agent;
- about 7.0–12% by weight of a copper flake.

* * * * *